US006374582B1

(12) United States Patent
Agne et al.

(10) Patent No.: US 6,374,582 B1
(45) Date of Patent: Apr. 23, 2002

(54) METHOD AND DEVICE FOR HANDLING OF PAPER BAGS BY AUTOMATIZED PACKING OF CAN LIDS

(75) Inventors: Weine Agne, Mullsjo; Magnus Wigenstedt, Mullsjö, both of (SE)

(73) Assignee: Nordisk Platindustri Benetec AB (SE)

( * ) Notice: Subject to any disclaimer, the term of this patent is extended or adjusted under 35 U.S.C. 154(b) by 0 days.

(21) Appl. No.: 09/445,066

(22) PCT Filed: Jun. 4, 1999

(86) PCT No.: PCT/SE98/01057

§ 371 Date: Dec. 1, 1999

§ 102(e) Date: Dec. 1, 1999

(87) PCT Pub. No.: WO98/55361

PCT Pub. Date: Dec. 10, 1998

(51) Int. Cl.[7] ..... B65B 43/30

(52) U.S. Cl. ..... 53/459; 53/571; 53/254; 53/469

(58) Field of Search ..... 53/571, 573, 254, 53/386.1, 459, 469

(56) References Cited

U.S. PATENT DOCUMENTS

| | | | | | |
|---|---|---|---|---|---|
| 2,753,097 | A | * | 7/1956 | Kindseth | 53/571 |
| 3,421,287 | A | * | 1/1969 | Sheets | 53/573 |
| 3,557,526 | A | * | 1/1971 | Hartmann | 53/567 |
| 3,945,173 | A | * | 3/1976 | Buzzi | 53/571 |
| 4,078,358 | A | * | 3/1978 | Henderson | 53/573 |
| 4,156,334 | A | | 5/1979 | Burgat et al. | 53/385 |
| 4,345,629 | A | * | 8/1982 | Inglett | 53/573 |
| 4,397,131 | A | | 8/1983 | Anderson | 53/254 |
| 4,417,435 | A | | 11/1983 | Wakamatsu et al. | 53/532 |
| 4,537,015 | A | | 8/1985 | Inglett, Jr. et al. | 53/386 |
| 4,840,016 | A | | 6/1989 | Muller, Jr. | 53/459 |
| 4,873,815 | A | | 10/1989 | Tetenborg et al. | 53/386 |
| 4,914,895 | A | | 4/1990 | Knuckhermann et al. | 53/571 |
| 5,177,939 | A | | 1/1993 | Lipes | 53/572 |

* cited by examiner

*Primary Examiner*—John Sipos
(74) *Attorney, Agent, or Firm*—Orum & Roth

(57) ABSTRACT

The present invention relates to a method and a device for picking-up and opening in the shape of elongate bags for automatic packing of cylindrical articles, preferably can lids. The method is charaterized by picking-up essentially flattened packages from a package magazine by means of pick-up means, opening the individual package by application thereon, at least in the area of the opening-mouth end of bags, of surface-holding means to opposite sides of the package and thereafter moving said means away from the package and then moving said means apart whereby the package mouth is distended. the device comprises magazine (1) for holding essentially flattened packages, a pick-up means (2) picking up packages from said magazine, package-opening, surface-opening means (3, 6) arranged to be applied on opposite sides of the individual package in the area of the mouth-opening end thereof and to open up the mouth of said package while being displaced away from one another in an essentially perpendicular direction relative to the plane of said package, and distending means (7,8) arranged to be inserted through the opening mouth of the package and thereafter to be moved apart, thereby to force open the mouth of the package.

8 Claims, 2 Drawing Sheets

METHOD AND DEVICE FOR HANDLING OF PAPER BAGS BY AUTOMATIZED PACKING OF CAN LIDS

The present invention relates to a method and to a device for picking-up and opening packages in the shape of elongated bags for automatic packaging of cylindrical articles, preferably can lids.

The process of packaging can lids in bags has been subjected to increasing automation in recent years. As examples of devices designed for this purpose may be mentioned those disclosed in the Swedish Published Patent Application 9401920-5 and the PCT Application SE97-00233, both in the name of Applicants. One problem encountered in these prior-art devices is connected with the step involving picking-up an empty bag and thereafter opening the same sufficiently to enable it to be filled with lids. The problems which the present invention particularly sets out to solve are to prevent advancement of several bags simultaneously and to ensure that the bag mouths are open to a sufficient degree when the lids are about to be entered into the bags.

Consequently, one object of the present invention is to provide a method and a device for handling bags in the process of automated packaging of can lids, by means of which method and device the above referred-to problems are eliminated.

This object is attained by means of the method and the device defined in the appended claims.

For exemplifying purposes, the invention will be described in more detail in the following by way of some embodiments thereof and with reference to the accompanying drawings, wherein.

Figure 1:
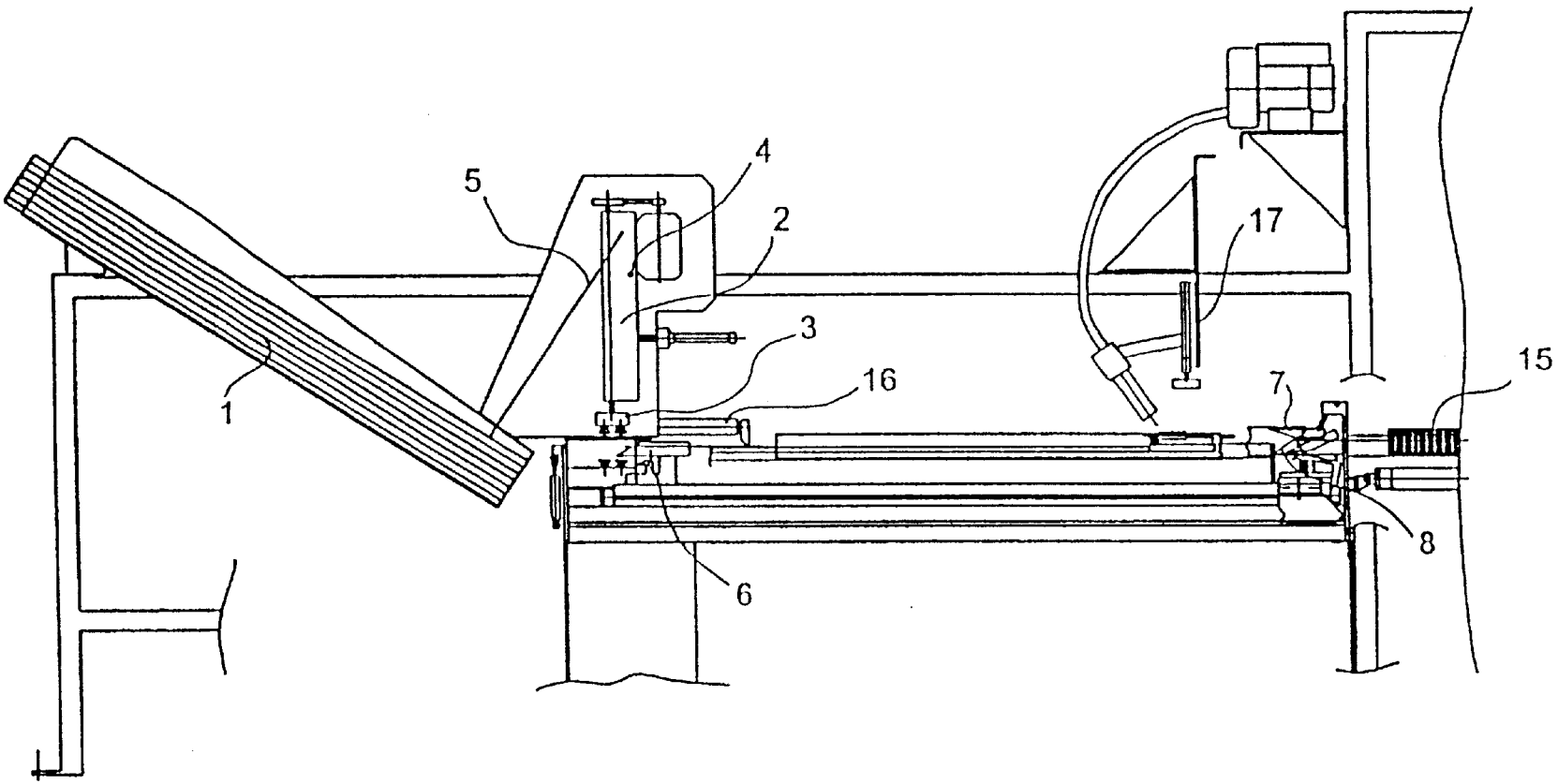
FIG. 1 is a lateral view of a device in accordance with one embodiment of the invention.

A bag handling device in accordance with one embodiment of the invention, illustrated in FIG. 1, comprises a bag magazine for holding essentially flattened bags and designed as a U-shaped channel which is inclined at an angle of about 30 degrees and which holds a number of bags therein. Owing to the thus inclined attitude of the bag magazine the gravitational force becomes instrumental in ensuring that the open ends of the bags will abut against the lower end wall of the bag magazine 1, whereby a bag reference edge is formed. This is an important feature since the bags could be of varying lengths and in addition they may place themselves in relative displaced positions as they are being filled into the magazine The device likewise comprise pick-up means comprising a pivotable pick-up unit 2 formed with suction cups 3 and arranged to pick up the uppermost bag in the magazine. The pick-up unit 2 is arranged to pivot about a pivot point 4, and in the drawing figure a dashed line illustrates the outwardly pivoted position 5 of the pick-up unit. In addition, the suction cups 3 are displaceable in the lengthwise direction of the pivot arm. The bag is pulled out of the magazine with the aid of the pick-up unit 2 as said unit is pivoted to its uppermost, outer position 5, thereby causing the suction cups to be lowered into contact with the bags, and is thereafter pivoted back to its vertical position. As the bag is thus pulled out of the magazine, it slides across brush edges or the like, which prevents further bags from accompanying the one being pulled out. The bag is then moved perpendicularly downwards onto a plate 6 underneath, on which suction cups are mounted. When the bag adheres to the lower suction cup unit 6 by the suction force produced by the latter, the pick-up unit 2 is retracted somewhat and the bag opens.

Figure 2:
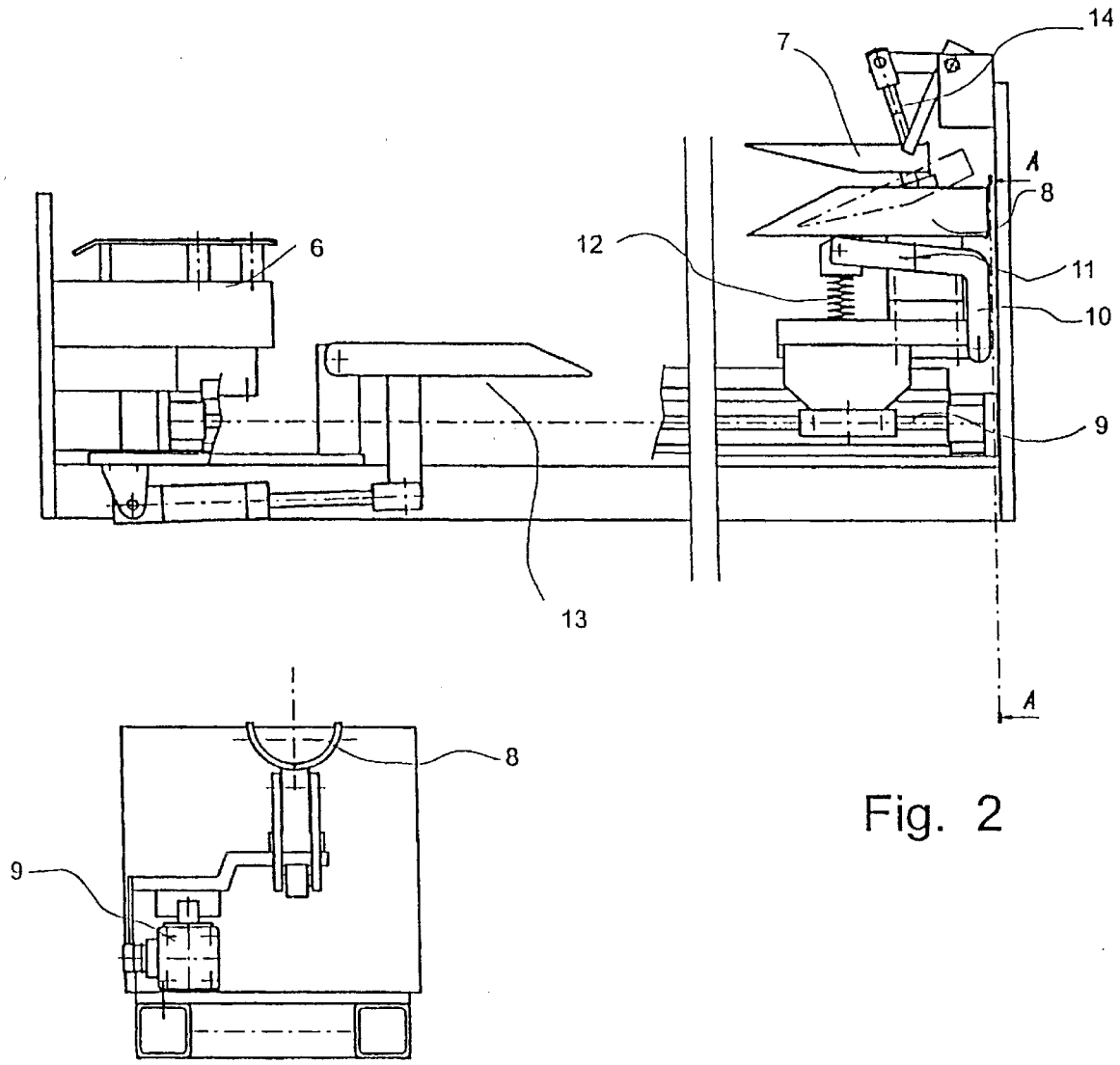
FIG. 2 is a lateral view of the distending means of the device illustrated in FIG. 1.

The device likewise comprises a distending means in the form of a horn which is divided into one upper part 7 and one lower part 8. As illustrated in FIG. 2, the lower part 8 is attached to a rail guide 9 forming part of a linear cylinder. The lower part 8 of the horn is arranged to travel to a pick-up point positioned adjacent the lower vacuum unit 6, in order to pick-up the bag therefrom and to pull it to the can-lid filling point. Underneath the horn is mounted a securing unit 10, securing the bag to the horn by mechanically clamping it thereto. This securing unit 10 is pivotal about a pivot axis 11 and it is biased into engagement with the lower horn part by means of a spring 12. An abutment means 13 is provided at the pick-up point, said abutment means bearing against the part of the securing unit that is disposed at the opposite side of the pivot axis 11. The abutment means is pivotal and is released in response to the securing unit 10 being pivoted away from the lower horn part 8. This enables the horn to be introduced into a package in such a manner that the package is being sandwiched between the horn and the securing unit. When the abutment means 13 is subsequently pivoted back to its former position, the bag is clamped in position mechanically. As a result, the bag may subsequently be moved at a high speed without any risk of it separating from the means carrying it and thereby slow down the process.

The upper part of the horn 7 is attached in an articulated joint mounted in the front end wall of the packaging module. Via a pneumatic cylinder 14, the joint may perform a tilting movement, as illustrated by the dash-and-dot line in FIG. 2. When assuming its lower, folded position, the upper part is nested inside the lower part of the horn and therefore it may conveniently be inserted into the interior of the opened bag. When pivoted upwards, it will immobilise the bag in the open position of the latter. A monitoring optical transducer detects whether or not the bag is open by scanning the upper quadrant of the bag.

In the filling position, the bag mouth is distended by the horn parts 7, 8 as the latter are being pivoted away from one another, whereupon lids are pushed off from a queue of lids 15. In this operation, the lids are forced into the bags by the extending arm of a cylinder unit. The securing unit 10 and the spring 12 could be adapted to exert a retaining force of sufficient magnitude to ensure that the lids are pressed into the bag and are compacted into close contact with one another therein before the force exerted by the cylinder-unit arm causes separation of the bag from the horn parts. As the bag is thus released, it is moved into contact with an abutment means 16 and as a result, the lids are compacted further. The bag is then closed by means of closure means 17 which do not, however, form part of the present invention.

In operation, the bag pick-up means 2 is pivoted into position above the bag magazine 1. The plate supporting the suction cups 3 is lowered into the magazine, the vacuum means being in activated condition. As the suction cups reach down to the uppermost bag, they grip the bag and are then again pulled upwards. When being thus pulled, the bag moves past brush edges, which prevents the bag underneath from accompanying the upper one, which it otherwise might have done on account of the paper material being permeable to vacuum.

When the suction plate 3 has reached its upper end position, the bag pick-up means 2 pivots back to its vertical position. The bag is then lowered to a position on top of the lower vacuum unit 6. As the vacuum guard of the latter indicates that the bag is held by the lower unit, the suction plate 3 is again raised and in response to a signal from a transducer, also indicating "open-bag" condition, it stops. Upon indication of an "open-end" condition, the lower part 8 of the horn is advanced along the machine to the pick-up point and into the interior of the open bag. Upon arrival of the horn part 8, the securing unit 10 secures the bag to the horn and the bag is pulled off the pick up-point and is moved to the lid filling point.

In this process, the upper part 7, too, of the horn will be introduced into the bag. The upper part 7 of the horn is then pivoted upwards and an optical transducer indicates the condition "bag open".

The bag is now ready to receive a charge of can lids.

Alternatively, also the upper part 7 of the horn could, of course, be displaceable, in which case both horn parts 7 and 8 are moved to the pick-up point and are introduced together into the bag mouth.

The device and the method in accordance with the invention have been described herein by means of one embodiment. Several varieties are, however, possible. For example, the pick-up means may have a different configuration and other means than suction cups may be used to retain the bags, such as electric or magnetic field creating devices. Further, the horn and the securing unit may be designed in a different manner and still have the same function. These and other modifications must be regarded to be within the scope of the invention as the latter is defined in the appended claims.

What is claimed is:

1. A method of picking-up and opening packages in the shape of elongate bags for automatic packaging of cylindrical articles therein, preferably can lids, said method comprising the steps of picking-up each individual, essentially flattened package from a package magazine by means of pick-up means (2);

opening the individual package by application thereon, at least in the area of the opening-mouth end of the bags, of surface-holding means (3, 6) to opposites sides of the package and thereafter moving said means away from one another in an essentially perpendicular direction relative to the plane of the package; and introducing distending means (7, 8) into the mouth of the package, wherein in the course of the pick-up step, the package is transferred from the magazine to a pick-up point and further to a filling point, during which transfer the package is moved essentially in its lengthwise direction;

displacing said distending means between said pick-up point and said filling point, during which displacement said distending means is moved to the pick-up point, where it grips an open-mouth package and thereafter pulls said package to the filling point, where said package may be filled with articles;

at the filling point said distending means are urged apart, thus distending said package mouth.

2. A method as claimed in claim 1, wherein at said pick-up point said distending means (7, 8, 10) also exert a mechanical clamping action on the package.

3. A method as claimed in claim 1, wherein surface-holding means (3, 6) comprise suction cups.

4. A device for picking up and opening packages in the shape of elongate bags for automatic packaging of cylindrical articles, preferably can lids, said device comprising a magazine for holding essentially flattened packages, a pick-up means picking up packages from said magazine, package-opening, surface-holding means arranged to be applied on opposite sides of the individual package in the area of the mouth-opening end thereof and to open up the mouth of said package while being displaced away from one another in an essentially perpendicular direction relative to the plane of said package, characterized in that the magazine is disposed downstream in the direction of prolongation of the lids to be filled into said package, means for moving said pick-up means in the course of the pick-up step to transfer each individual package from the magazine to a pick-up point, and in that it further comprises distending means for insertion through the opening mouth of the package, means for displacing, said distending means being displaceable between a pick-up point and a filling point, said distending means further arranged to grip an opened package in the pick-up point and to transfer said package to said filling point while pulling said package essentially in the lengthwise direction of the latter.

5. A device as claimed in claim 4, characterized in that said distending means comprise parts, preferably two parts, adapted to be inserted into the interior of the package and, when pivoted away from one another, to distend the package mouth, and also comprise an external retaining part which is movable into abutment against one of the inserted distending-means parts in order to clampingly retain a package sandwiched between said retaining mean part and said distending mean parts.

6. A device as claimed in claim 5, wherein than the bag magazine (5) is arranged at an angle so as to ensure that the opening-mouth end of the packages contained in said magazine is disposed at a lower level than the opposite package end.

7. A device as claimed in claim 6, wherein the surface-holding means (3, 6) comprise suction cups.

8. A device as claimed in claim 7, wherein said pick-up means comprise a pivotal arm (2) arranged to pivot between the magazine and the opening means, said arm supporting package-retaining suction cups (3) at one of its ends.

* * * * *

UNITED STATES PATENT AND TRADEMARK OFFICE

CERTIFICATE OF CORRECTION

PATENT NO. : 6,374,582 B1
DATED : April 23, 2002
INVENTOR(S) : Weine Agne et al.

It is certified that error appears in the above-identified patent and that said Letters Patent is hereby corrected as shown below:

Title page,
Item [22], change "[22] PCT Filed: June 4, 1999" to read
-- [22] PCT Filed: June 4, 1998 --

Signed and Sealed this

Sixteenth Day of July, 2002

*Attest:*

*Attesting Officer*

JAMES E. ROGAN
*Director of the United States Patent and Trademark Office*